US006953912B2

(12) United States Patent
Alday Lesaga

(10) Patent No.: US 6,953,912 B2
(45) Date of Patent: Oct. 11, 2005

(54) DOMESTIC STEAM IRON WITH AUTONOMOUS STEAM ASSEMBLY HEATED BY SEPARATE HEATING ELEMENT

(75) Inventor: Francisco Javier Alday Lesaga, Vitoria (ES)

(73) Assignee: Celaya Emparanza y Galdos, Internacional, S.A., Alava (ES)

( * ) Notice: Subject to any disclaimer, the term of this patent is extended or adjusted under 35 U.S.C. 154(b) by 0 days.

(21) Appl. No.: 10/289,940

(22) Filed: Nov. 7, 2002

(65) Prior Publication Data

US 2003/0094445 A1 May 22, 2003

(30) Foreign Application Priority Data

Nov. 21, 2001 (ES) ..... 200102578
Sep. 30, 2002 (ES) ..... 200202206

(51) Int. Cl.[7] ..... D06F 75/00

(52) U.S. Cl. ..... 219/251; 219/255; 38/77.83; 38/82

(58) Field of Search ..... 219/251, 255, 219/245, 252; 38/77.1–77.9, 82

(56) References Cited

U.S. PATENT DOCUMENTS 2,499,835 A * 3/1950 Rakos ..... 38/77.7
3,110,975 A * 11/1963 Kircher ..... 38/77.7
3,263,350 A * 8/1966 Salomon ..... 38/77.7
4,571,862 A * 2/1986 Costa ..... 38/77.81
5,042,179 A * 8/1991 van der Meer ..... 38/77.83
5,279,054 A * 1/1994 Chasen ..... 38/77.7
5,883,358 A * 3/1999 Brandolini et al. ..... 219/258
6,263,596 B1 * 7/2001 Pedron et al. ..... 38/77.7

FOREIGN PATENT DOCUMENTS

| | | |
|---|---|---|
| DE | 4107236 | * 9/1992 |
| DE | 4134963 | * 4/1993 |
| DE | 4216748 | * 11/1993 |
| FR | 2543180 | * 9/1984 |
| GB | 2217352 | * 10/1989 |
| JP | 2001-204998 | * 7/2001 |

* cited by examiner

*Primary Examiner*—John A. Jeffery
(74) *Attorney, Agent, or Firm*—Nields & Lemack

(57) ABSTRACT

Soleplate of domestic steam iron, basically constituted by a an ironing element (1), which is that which comes into contact with the item to be ironed, and a heating element (2) which heats said ironing element (1) by means of a thermostatic element (3) which regulates the ironing temperature, which independently of the assembly of ironing element (1), heating element (2) and thermostatic element (3), the soleplate of domestic steam iron (1–2) according to the invention incorporates an autonomous steam assembly (4) which is composed of a steam chamber (5) which has a water supply conduit (6) connected to the reservoir of the domestic iron, and whose steam chamber (5) has a separate heating element (7) which has its own thermostat (8) which regulates the temperature in that steam chamber (5); the steam assembly (4) has a steam outlet (9) connected to a complementary steam intake (10) which exists in the ironing element (1) for the correct passage of steam to the outlet holes.

9 Claims, 4 Drawing Sheets

Fig.2
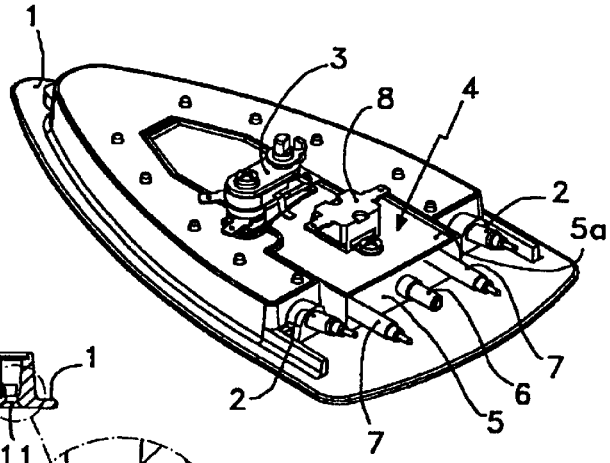
Fig.5
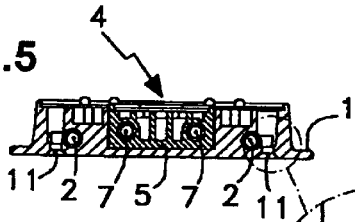
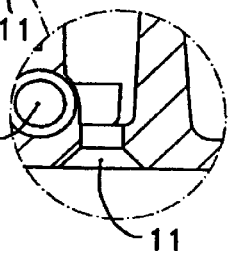
Fig.5a
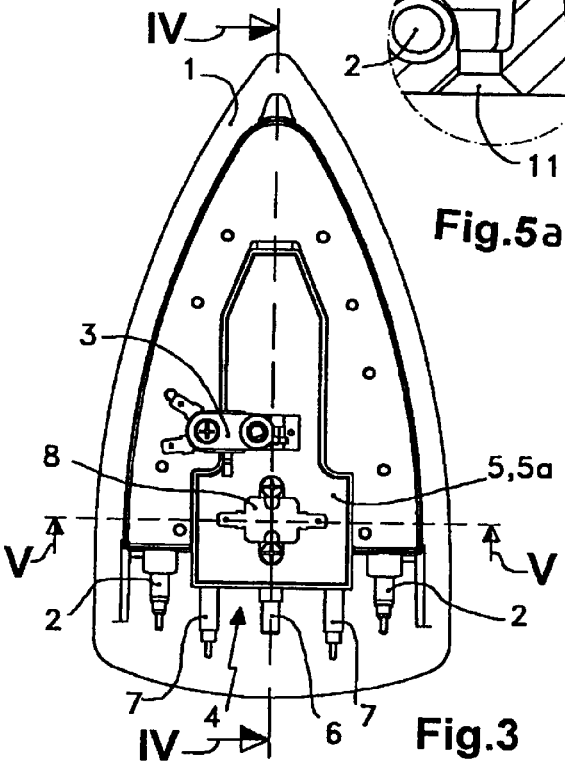
Fig.3
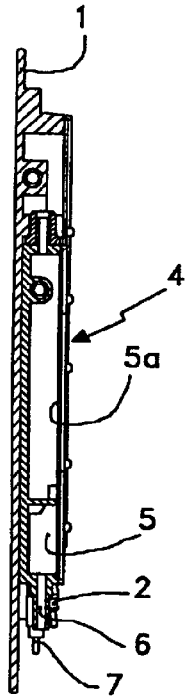
Fig.4

1
2
3
4
5
5a
6
7
8
9
10
12
13
14
20
21

DOMESTIC STEAM IRON WITH AUTONOMOUS STEAM ASSEMBLY HEATED BY SEPARATE HEATING ELEMENT

FIELD OF THE INVENTION

This invention concerns a soleplate for a domestic iron, whose constitution is composed of an ironing element, which is that which comes in contact with the item to be ironed, and a heating element which produces the heating of the ironing element, with the mediation of a thermostatic element charged with controlling the ironing temperature required for each type of item and fabric.

The water vapor which exits through a number of holes placed in said ironing element, comes from a steam heating chamber which is supplied with water from the water reservoir of the domestic steam iron.

In the Invention we present some improvements to optimize the design of the domestic steam iron, as well as to increase the reliability and safety of its functioning and to propose optional constructive solutions which are able to be produced at a lower cost.

PRIOR ART TECHNOLOGY

In all the domestic steam irons which are known at this time, the heating of the steam chamber is produced by the same heating element which heats the ironing element.

These domestic steam irons work in a range of temperatures contained between 100° C. and 200° C. In the zone of this thermal range which is close to 100° C. the steam is not saturated and is designated as wet steam, as it is close to the limit between the liquid and vapor states of water, and there is still a considerable amount of liquid water, so that it is very easy for a portion of the water in vapor state to change to its liquid state when a relatively small decrease in temperature is produced. On the contrary, as the temperature increases a more saturated water vapor is obtained, which is designated as dry steam (approximately, above 120° C.), and the liquid phase becomes less and less important; in such a way that the higher part of the given thermal range is more and more stable, in that significant decreases in temperature are necessary for the water vapor to change to its liquid state.

Due to the conditions explained, in the practice of ironing there is no problem when working in the higher area of the mentioned range of temperatures; then, there is good production of dry steam and the high temperature of the ironing element is appropriate for the fabric which is being ironed and the item does not suffer any damage for this reason.

Nevertheless, when ironing delicate fabrics and items, it is necessary that the temperature of the ironing element be within the lower limits of the mentioned temperature range. As this ironing element and the steam heating chamber are heated by the said same and only heating element, the result is that the steam produced and available for ironing is wet steam. One consequence of this is that a drop of water is produced which wets the item, which is bothersome and reduces the quality of the ironing. This phenomenon is aggravated by the cooling of the ironing element around the holes for the ejection of steam, cooling which has a significant influence as it is very close to the temperatures of the steam ejected and of the ironing element.

In this field there exists another problem for which this invention also offers a solution. It has to do with the sudden cooling which occurs in the steam chamber of the domestic steam iron when, during the ironing, it is filled with water at a much lower temperature than that of the water reservoir of the same.

EXPLANATION OF THE INVENTION AND ADVANTAGES

In response to this situation, the present invention proposes a soleplate of a domestic steam iron that, while similar to those of the above-mentioned prior art, presents a peculiar constitution of elements in which, independently of the assembly of ironing element, heating element and thermostatic element which conventional a domestic steam irons have, the soleplate of domestic steam iron according to the invention incorporates an autonomous steam assembly which is composed of a steam chamber which has a water supply conduit connected to the water reservoir of the domestic iron, and whose steam chamber has a separate heating element which has its own thermostat which regulates the temperature in this steam chamber; the autonomous steam assembly has a steam outlet connected to a complementary steam intake which exists in the ironing element for the correct passage of steam toward the exit holes.

This proposed constitution has the great advantage of making the production of steam thermally independent with respect to the ironing element. This creates the tremendous advantage of being able to use dry steam regardless of the ironing temperature which the ironing element should have as a function of the item to be ironed; within the working range of these domestic steam irons the temperature of the ironing element does not endanger the item; rather, to the contrary, it provides high quality ironing for the lower ironing temperatures without producing water drops; in addition, as there is such a temperature difference between the steam ejected and the ironing element, we avoid the effect of cooling around the ejection holes which was discussed previously as a multiplier of the phenomenon of water drops in the domestic steam irons known until now. Furthermore, this thermal independence makes it possible for the ironing element to work at a lower temperature than the lower limit of the range of the known domestic steam irons, thanks to being able to do so with dry steam; that is, it can be used for more delicate ironing than that of these known irons.

According to the invention said autonomous steam assembly is connected to, or placed against, or housed in, said soleplate of a domestic iron and properly attached. That is, any manner of connection between these units will be comprised in the subject of the invention on the basis of establishing thermal independence between the same.

According to another particular feature of the invention, between said autonomous steam assembly and said soleplate of a domestic steam iron there exists a thermal isolation by means of a physical heat-insulating material or by means of a physical separation. In each case, the most convenient solution will be chosen as a function of the desired uses for the domestic steam iron constructed following this invention.

According to the improvements to this invention, it happens that the usual water reservoir of the domestic steam iron is connected to the intake of said steam chamber by means of a usual electrical pump provided with a usual micro-switch which has the characteristic that simultaneously this micro-switch in its activated state establishes an electrical bridge between the terminals of the thermostat which, by means of an electrical connection in series, is connected to the heating element regulating the temperature in the steam chamber, and with the characteristic that said steam chamber has an auxiliary thermostat which is electrically connected in series with said thermostat belonging to said heating element of the steam chamber and upstream from this same heating element, allowing that said auxiliary thermostat is calibrated for a temperature value which is conveniently higher than that of the thermostat and lower than that corresponding to a primary thermal fuse provided in said steam chamber.

This design permits the thermostat of the steam chamber to remain off while the chamber is being filled with water by the electrical pump, which means that while this electrical pump is activated, the heating element of the steam chamber automatically turns on to heat the water entering the chamber; when the electrical pump becomes inactive again, said thermostat returns to an operative state.

The auxiliary thermostat acts as a safety measure against the possibility of overheating during this filling process, in that it cuts off the flow of electrical current by said heating element before the temperature in the steam chamber reaches the level at which it will burn out the primary thermal fuse, which is the final safety device for preventing the iron from burning.

Other features proposed in these improvements are: that said water feed conduit coming from the water reservoir of the domestic steam iron is connected to the intake which is provided in the upper part of said steam chamber; that in place of said thermostat and auxiliary thermostat there exists an electronic thermostatic element installed in said steam chamber and that, due to its great precision and quick response time, provides by itself equal functionality to that provided by said thermostat and auxiliary thermostat; that there exists a secondary thermal fuse which is provided in said ironing element.

Another feature proposed by these improvements is that the autonomous steam assembly and the ironing element may be made in such a manner that they are physically integrated in a one-piece body in which this steam assembly is physically separated from said ironing element by a lower and a lateral insulator while said steam assembly and ironing element are physically connected exclusively by means of a partition located at the extreme front end of the steam assembly, whose partition is crossed by a passage in which said steam outlet of the steam assembly and steam intake in the ironing element are integrated. This constructive solution is advantageous because the productive process can be simplified, reducing the number of pieces, resulting in saving time and assembly means.

DRAWINGS AND REFERENCES

To better understand the nature of the present invention, in the attached drawings we present a preferred industrial embodiment, which has the character of a simply illustrative and not-limiting example.

FIG. 2 is a perspective view which shows the assembly of the invention according to FIG. 1.

FIG. 3 is a view in orthogonal projection which shows the upper level corresponding to the assembly of the invention shown in FIG. 2.

FIG. 4 is the section IV—IV which is indicated in FIG. 3, where the representation of the thermostat (8) has been removed.

FIG. 5 is the section V—V which is indicated in FIG. 3, where the representation of the thermostat (8) has been removed.

Figures 6, 6A, 7:
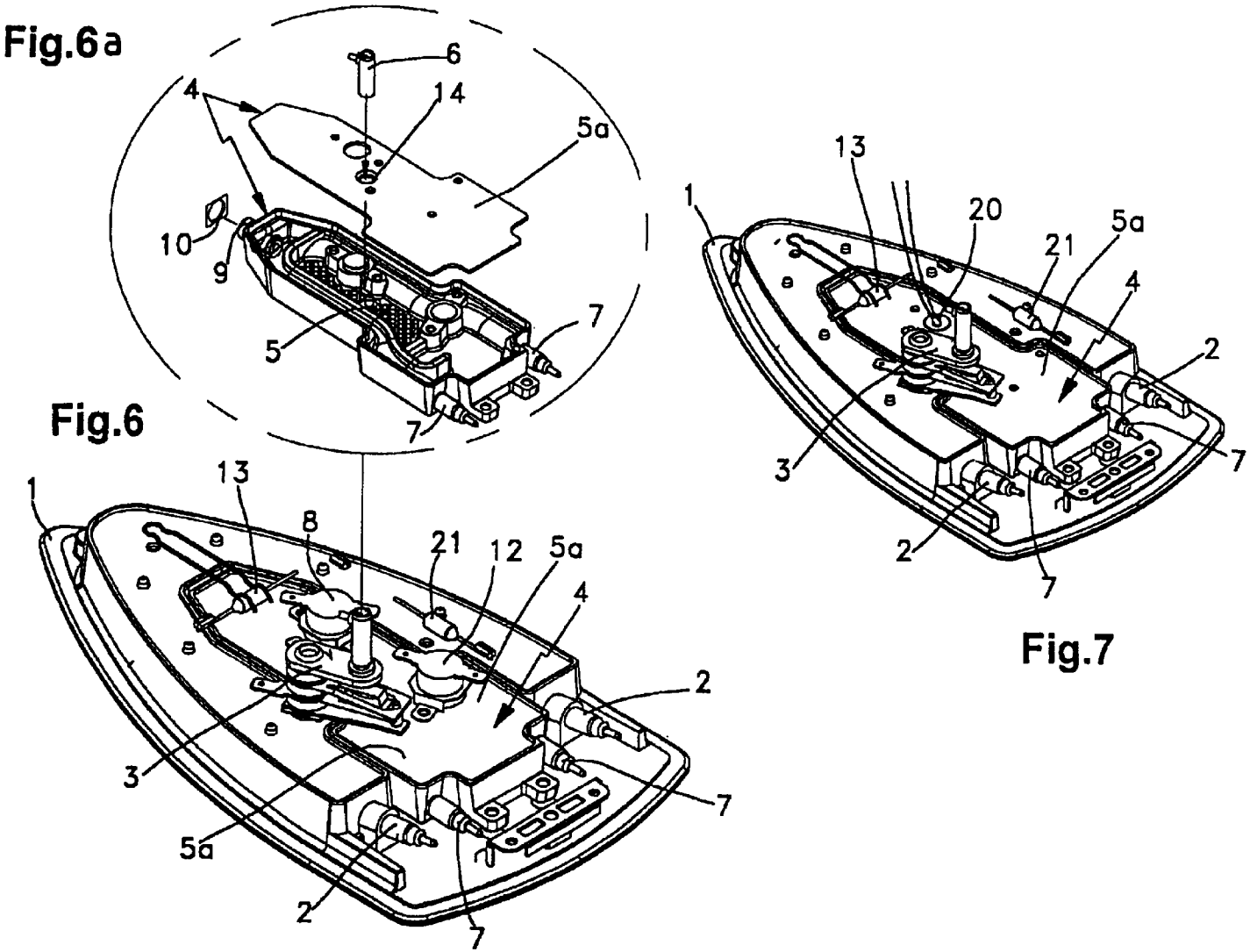

FIG. 5*a* is a detailed view of a portion of the autonomous steam assembly;

FIG. 6 is a view in perspective which shows an embodiment according to the improvements to this invention, similar to FIG. 2 of this Patent.

FIG. 6*a* is an exploded view in perspective of the steam chamber (4) and which shows in relative position of assembly the steam chamber (5), its cap (5*a*) and the water feed conduit (6); here we can also see that the interior base of the steam chamber (5) has a surface with prominences to promote the formation and release of the steam bubbles.

FIG. 7 is a view similar to FIG. 6 and shows another embodiment according to said improvements.

Figures 8, 9, 10:
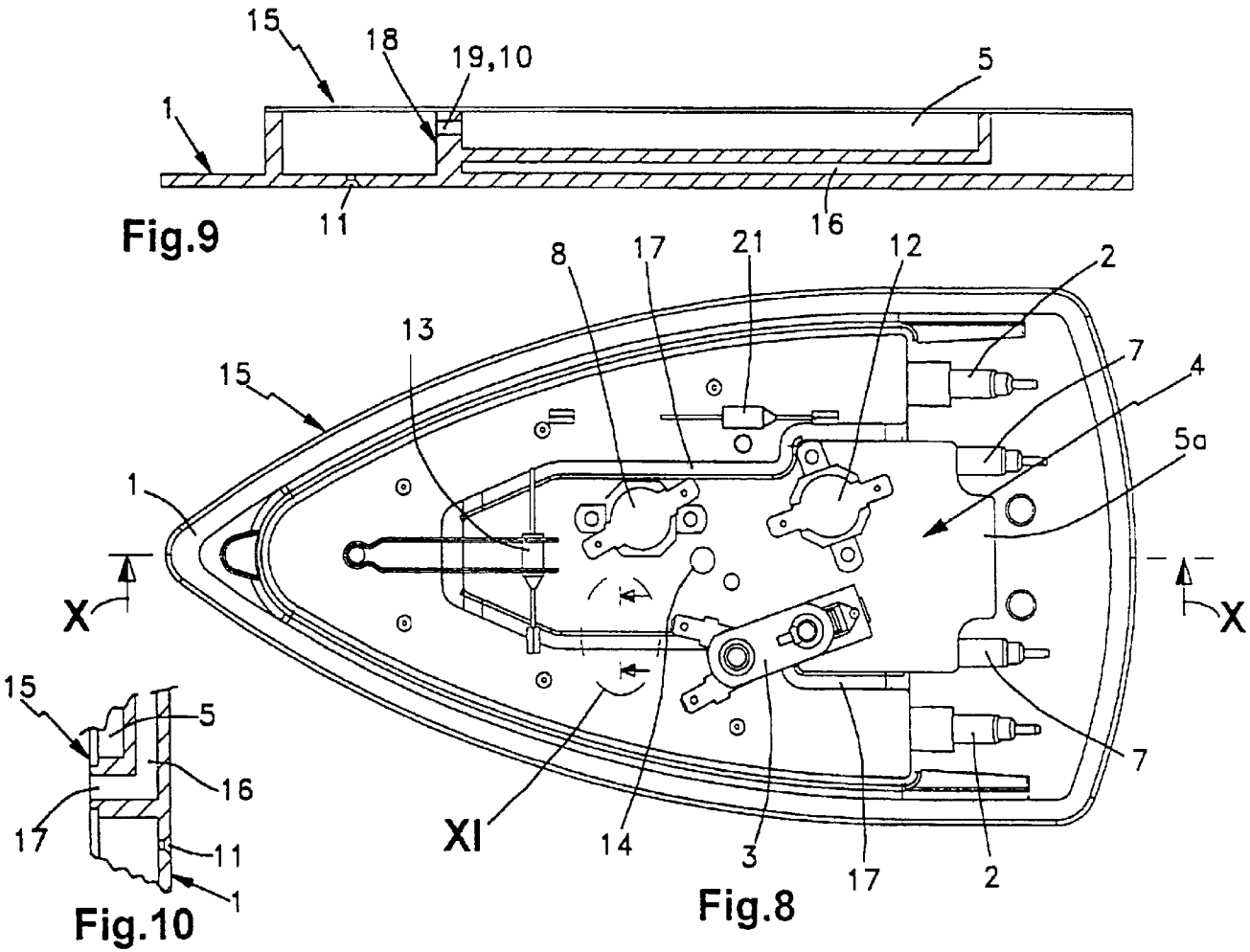

FIG. 8 is a view in orthogonal projection which shows the upper level of an embodiment according to the improvements to the invention which employs a onepiece body (15).

FIG. 9 is the section X—X indicated in FIG. 8, but referring exclusively to the one-piece body (15).

FIG. 10 is an enlargement corresponding to the section marked in detail XI indicated in FIG. 8.

In these figures the following references are indicated:

1. —Ironing element
2. —Heating element
3. —Thermostatic element of the iron (1)
4. —Autonomous steam assembly
5. —Steam chamber
5*a*. —Cap of the steam chamber (5)
6. —Water supply conduit
7. —Heating element of the steam chamber (5)
8. —Thermostat of the steam chamber (5)
9. —Steam outlet of the steam assembly (4)
10. —Steam intake of the ironing element (1)
11. —Steam exit holes
12. —Auxiliary thermostat
13. —Primary thermal fuse
14. —Water intake of the steam chamber (5)
15. —One-piece body
16. —Base insulating means
17. —Lateral insulating means
18. —Partition of one-piece body (15)
19. —Passage in the partition (18)
20. —Electronic thermostatic element
21. —Secondary thermal fuse

DESCRIPTION OF A PREFERRED EMBODIMENT

Figure 1:
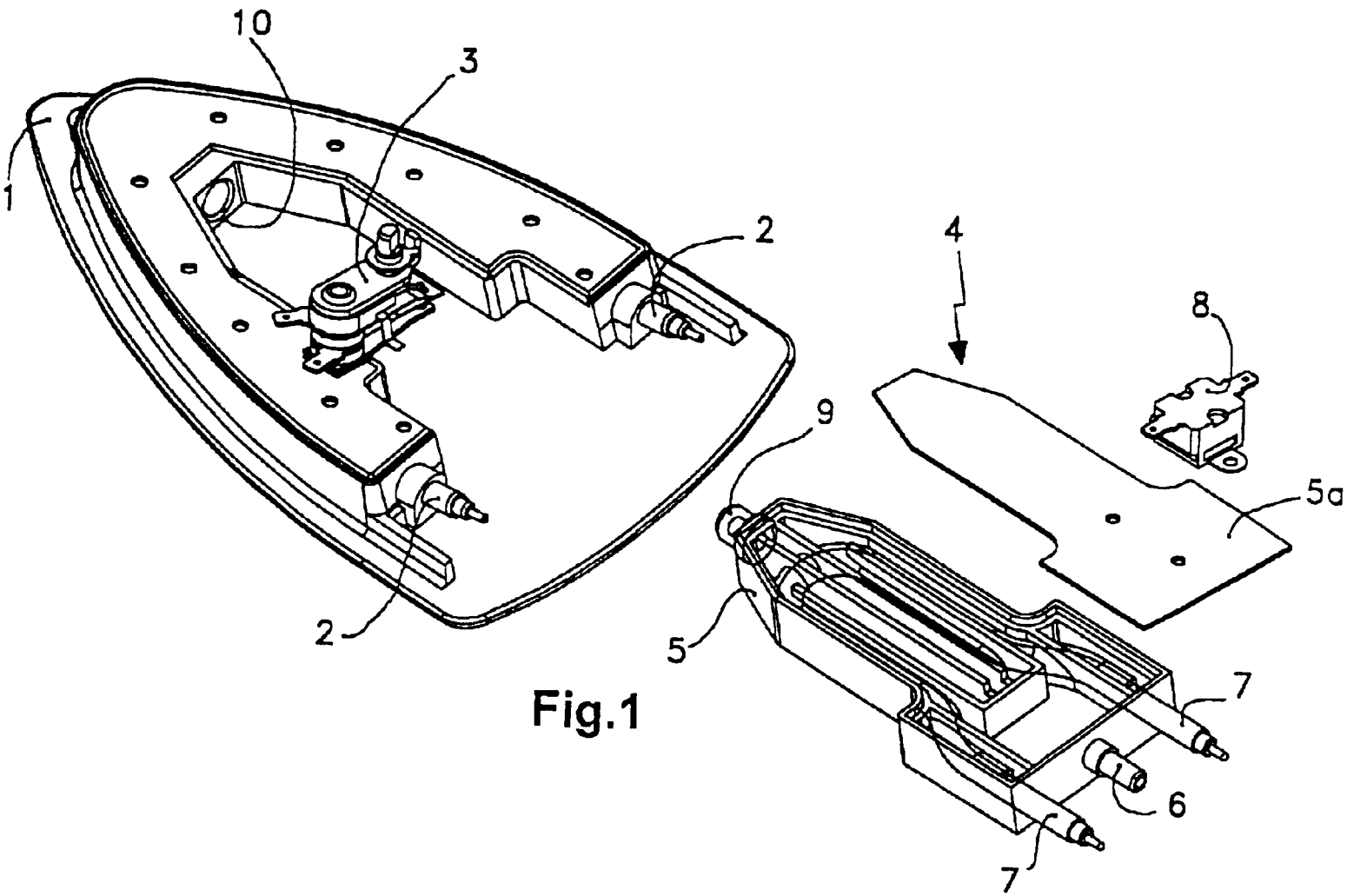
FIG. 1 is an exploded perspective view which illustrates the subject of the invention.

In relation to the drawings and references enumerated above, a preferred mode of embodiment of the invention is presented in the attached sheets, particularly concerning (FIG. 1) a soleplate of a domestic seam iron (1–2) that is basically comprised of an ironing element (1) which is that which enters into contact with the item to be ironed, and a heating element (2) that heats said ironing element (1) by means of a thermostatic element (3) that regulates the ironing temperature.

According to the invention, the soleplate of domestic steam iron (1–2) foreseen presents the special feature that, independently of said assembly of ironing element (1), heating element (2) and thermostatic element (3), of incorporating an autonomous steam assembly (4) which is composed of a steam chamber (5) which has a water supply conduit (6) connected to the water reservoir of the domestic iron, and whose steam chamber (5) has a separate heating element (7) which has its own thermostat (8) which regulates the temperature in this steam chamber (5); the autonomous steam assembly (4) has a steam outlet (9) connected with a complementary steam intake (10) which exists in the ironing element (1) for the correct passage of steam toward the exit holes (11). The same FIG. 1 clearly illustrates this proposed constitution, where the cap (5*a*) of the steam chamber (5) is removed, allowing the interior of this chamber to be seen.

According to the invention said autonomous steam assembly (4) is connected to, or placed against, or housed in, said soleplate of domestic iron (1–2) and properly attached. One of the possible solutions, in this respect, is that of the assembly represented in FIGS. 2 to 5, wherein said autonomous steam assembly (4) is located in a central space left by the heating element (2) of the soleplate of the conventional domestic iron (1–2) which is represented disassembled in the exploded view of FIG. 1.

In this simple manner the independence of the heating elements of the ironing element (1) of the conventional domestic iron (1–2) and of the steam chamber (5) has been achieved. This now makes it possible for a domestic steam iron to iron with dry steam even when the ironing temperature of the ironing element (1) may be at the lowest setting for the most delicate ironing task. In addition, it is now possible to iron items and fabrics which are even more delicate, in which the ironing element uses a lower temperature than that of the known domestic steam irons, thanks to the ability to work with dry steam in these situations.

Another special feature of the invention is that between said autonomous steam assembly (4) and said soleplate of domestic steam iron (1–2) there is a thermal isolation, by means of a physical heat-insulating material or by means of a physical separation; all of which is done as a function of the desired use in each case and relative to the price/quality ratio.

The autonomous steam assembly (4) will be conveniently attached so as to avoid its physical separation with use.

In the improvements to the invention we consider a feature which consists in that said water reservoir of the domestic steam iron is connected with the entry to said steam chamber (5) by means of an electrical pump provided with a micro-switch which in its activated state establishes an electrical bridge between the terminals of one said thermostat (8) which, by means of an electrical connection in series, is connected to said heating element (7) regulating the temperature in said steam chamber (5), while said steam chamber (5) has an auxiliary thermostat (12) which is electrically connected in series with said thermostat (8) belonging to said heating element (7) of the steam chamber (5) and upstream from this same heating element (7), where said auxiliary thermostat (12) is calibrated for a temperature value that is conveniently lower than that corresponding to a primary thermal fuse (13) provided in said steam chamber (5). In FIG. 6 we can see an assembly of this type in which we can observe the placement of said thermostat (8) of the steam chamber (5), auxiliary thermostat (12) and primary thermal fuse (13). And in the exploded detail are shown the water feed conduit (6) which will be connected to the water intake (14) which, in this case, is placed in the cap (5*a*) of a said steam chamber (5) whose base is created with pyramid-shaped prominences which promote the quicker formation, better distribution and release of the steam bubbles in the heating of the water contained in its interior; this embodiment corresponds to the special features of the improvements in which said water feed conduit (6) coming from the water reservoir of the domestic steam iron is connected to a water intake (14) which is provided in the upper part of said steam chamber (5); in this detail the thermostat (8) and auxiliary thermostat (12) do not appear.

Another feature of the improvements can be seen in the embodiment shown in FIG. 7, whose properties have been previously indicated and which refers to the fact that instead of said thermostat (8) and auxiliary thermostat (12) there exists an electronic thermostatic element (20) installed in said steam chamber (5).

Another interesting feature of the improvements whose advantages have been previously indicated, is the embodiment illustrated by FIGS. 8 to 10 and which consists in that the autonomous steam assembly (4) and the ironing element (1) can be designed in such a way that they are physically integrated in a one-piece body (15) in which this steam assembly (4) is physically separated from said ironing element (1) by a lower insulating means (16) and a lateral insulating means (17), while such steam assembly (4) and ironing element (1) are physically connected only by means of a partition (18) located in the extreme front end of the steam assembly (4), whose partition is crossed by a passage (19) in which said steam outlet (9) of the steam assembly (4) and steam intake (10) in the ironing element (1) are integrated. In FIG. 9, we can clearly see the lower insulating means (16) as well as the passage (19) established in the partition (18), as well as the lateral insulating means (17) (together with this lower insulating means —16—) are shown in FIG. 10; in this embodiment said insulating means, lower (16) and lateral (17), are composed of air, but it is evident that any known and convenient means could be used for this purpose of thermal insulation.

What is claimed is:

1. In a soleplate of a domestic steam iron of the type having a water reservoir connected with the intake to a steam chamber (5) by means of an electrical pump provided with a micro-switch, the improvement comprising that simultaneously said micro-switch in its activated state establishes an electrical bridge between the terminals of the thermostat (8) which, by means of an electrical connection in series, is associated with the heating element (7) regulating the temperature in the steam chamber (5) and with the characteristic that said steam chamber has an auxiliary thermostat (12) which is electrically connected in series with said thermostat (8) belonging to said heating element (7) of the steam chamber (5) and upstream from the same heating element (7), which permits that said auxiliary thermostat (12) is calibrated for a temperature value that is conveniently higher than that of the thermostat (8) and lower than that corresponding to a primary thermal fuse (13) provided in said steam chamber (5).

2. The improved soleplate of a domestic steam iron according to claim 1, wherein the water feed conduit (6) coming from the water reservoir of the domestic steam iron is connected with an intake (14) which is provided in the central upper part of said steam chamber (5).

3. The improved soleplate of a domestic steam iron according to claim 1 or 2, having an autonomous steam assembly (4) and an ironing element (1), and wherein the autonomous steam assembly (4) and the ironing element (1) are able to be designed in such a way that they are physically integrated in a one-piece body (15) in which this steam assembly (4) is physically separated from said ironing element (1) by a lower insulating means (16) and a lateral insulating means (17), while said steam assembly (4) and ironing element (1) are physically connected exclusively by means of a partition (18) located at the extreme front end of the steam assembly (4), whose partition is crossed by a passage (19) in which said steam outlet (9) of the steam assembly (4) and steam intake (10) in the ironing element (1) are integrated.

4. The improved soleplate of a domestic steam iron according to claim 1 or 2, further characterized in that said thermostat (8) and auxiliary thermostat (12) are replaced by an electronic thermostatic element (20) installed in said steam chamber (5).

5. The improved soleplate of a domestic steam iron according to claim 3, further characterized in that said thermostat (8) and auxiliary thermostat (12) are replaced by an electronic thermostatic element (20) installed in said steam chamber (5).

6. The improved soleplate of a domestic steam iron according to claim 1 or 2, further characterized in that there exists a secondary thermal fuse (21) which is provided in said heating element (1).

7. The improved soleplate of a domestic steam iron according to claim 3, further characterized in that there exists a secondary thermal fuse (21) which is provided in said heating element (1).

8. The improved soleplate of a domestic steam iron according to claim 4, further characterized in that there exists a secondary thermal fuse (21) which is provided in said heating element (1).

9. The improved soleplate of a domestic steam iron according to claim 5, further characterized in that there exists a secondary thermal fuse (21) which is provided in said heating element (1).

* * * * *